US012385476B2

(12) United States Patent
Lu et al.

(10) Patent No.: US 12,385,476 B2
(45) Date of Patent: Aug. 12, 2025

(54) AIR COMPRESSOR

(71) Applicants: Weidong Lu, Los Altos, CA (US); Daisy Kwok, Los Altos, CA (US)

(72) Inventors: Weidong Lu, Los Altos, CA (US); Daisy Kwok, Los Altos, CA (US)

( * ) Notice: Subject to any disclaimer, the term of this patent is extended or adjusted under 35 U.S.C. 154(b) by 9 days.

(21) Appl. No.: 18/356,685

(22) Filed: Jul. 21, 2023

(65) Prior Publication Data

US 2025/0027488 A1 Jan. 23, 2025

(51) Int. Cl.

| | |
|---|---|
| ***F04B 27/02*** | (2006.01) |
| ***F04B 27/00*** | (2006.01) |
| ***F04B 35/04*** | (2006.01) |
| ***F04B 53/00*** | (2006.01) |
| *F04B 25/00* | (2006.01) |

(52) U.S. Cl.

CPC ..... *F04B 27/005* (2013.01); *F04B 35/04* (2013.01); *F04B 53/006* (2013.01); *F04B 25/005* (2013.01); *F04B 27/02* (2013.01)

(58) Field of Classification Search

CPC ..... F04B 27/02; F04B 27/005; F04B 35/04; F04B 25/005; F04B 53/006

See application file for complete search history.

(56) References Cited

U.S. PATENT DOCUMENTS 1,846,656 A * 2/1932 Rayfield ..... F04B 27/005 417/458
2008/0168898 A1* 7/2008 Hardin ..... F04B 39/123 92/153
2011/0256001 A1* 10/2011 Kobayashi ..... F04B 25/005 417/339

FOREIGN PATENT DOCUMENTS

CN 104074706 A * 10/2014 ..... F04B 23/06

OTHER PUBLICATIONS engineeringtoolbox.com, published Mar. 2023, URL: https://web.archive.org/web/20230324170016/https://www.engineeringtoolbox.com/pulley-diameters-speeds-d_1620.html (Year: 2023).*

* cited by examiner

*Primary Examiner* — Thomas Fink
(74) *Attorney, Agent, or Firm* — Frank Gao, Esq.

(57) ABSTRACT

The patent application discloses an air compressor. The air compressor comprises a pair of pistons, a motor, a flywheel, a pulley, a crankshaft. Each piston is reciprocable in a corresponding one of the cylinders so as to reciprocate along the axis of the corresponding cylinder to vary a working volume of the cylinder. The motor comprise an output shaft. The pulley transmits torque from said output shaft to said flywheel so as to rotate said flywheel about said axis upon rotation of said output shaft. The crankshaft interconnects said flywheel with said piston so as to reciprocate said piston in said cylinder upon rotation of said flywheel. The diameter of the pulley is smaller than that of said flywheel.

12 Claims, 4 Drawing Sheets

AIR COMPRESSOR

TECHNICAL FIELD

The present invention relates to an air compressor, and particularly relates to an air compressor that is mounted on a tank.

BACKGROUND

In the traditional two-stage compressor, the motor is directly connected to the crank and connecting rod mechanism of the compressor. Under high load conditions, the motor torque needs to be increased to meet the high load conditions, so that the cost of the motor and the whole machine will be greatly increased.

Therefore, there is a need to have a better and efficient compressed air control device with a high pressure air output and high torque.

SUMMARY

In one aspect, one embodiment discloses an air compressor. The air compressor comprises a pair of pistons, a motor, a flywheel, a pulley, and a crankshaft. Each piston is reciprocable in a corresponding one of the cylinders so as to reciprocate along the axis of the corresponding cylinder to vary a working volume of the cylinder. The motor comprises an output shaft. The pulley transmits torque from said output shaft to said flywheel so as to rotate said flywheel about said axis upon rotation of said output shaft. The crankshaft interconnects said flywheel with said piston so as to reciprocate said piston in said cylinder upon rotation of said flywheel. The diameter of the pulley is smaller than that of said flywheel.

Optionally in any aspect, the ratio between the diameter of the pulley and that of flywheel is about 27:104.

Optionally in any aspect, the air compressor further comprises a drive belt transmitting torque from said output shaft to said flywheel.

Optionally in any aspect, the air compressor further comprises a bearing supporting said flywheel for rotation about an axis.

Optionally in any aspect, the air compressor further comprises a shaft extending along said axis between said flywheel and said bearing, wherein said shaft has a first end portion and a second end portion.

Optionally in any aspect, said first end portion is journaled in said bearing for rotation about said axis.

Optionally in any aspect, the second end portion is received within a bore in said flywheel.

Optionally in any aspect, the air compressor further comprises a connecting rod, wherein the piston is configured to connect to one end of the connecting rod.

Optionally in any aspect, the cylinders have at least one low pressure cylinder and a high pressure cylinder.

Optionally in any aspect, the air compressor may further comprise a conduit connecting the low pressure cylinder and the high pressure cylinder.

In further another aspect, one embodiment discloses an air compressor. The air compressor comprises at least two separate cylinder housings, a pair of pistons, a motor, a flywheel, a pulley, and a drive belt. The at least two separate cylinder housings have each cylinder housing defining a cylinder with an axis. The axes are parallel and spaced apart. The pair of pistons with each piston is reciprocable in a corresponding one of the cylinders so as to reciprocate along the axis of the corresponding cylinder to vary a working volume of the cylinder. The motor has an output shaft. The pulley is on the output shaft of the motor. The drive belt connecting the pulley and flywheel. The drive belt transmits torque from said output shaft to said flywheel so as to rotate said flywheel about said axis upon rotation of said output shaft.

Optionally in any aspect, the air compressor further comprises a crank shaft interconnecting said flywheel with said piston so as to reciprocate said piston in said cylinder upon rotation of said flywheel.

Optionally in any aspect, the diameter of the pulley is smaller than that of said flywheel.

Optionally in any aspect, the ratio between the diameter of the pulley and that of flywheel is about 27:104.

Optionally in any aspect, the air compressor further comprises a shaft extending along said axis between said flywheel and said bearing.

Optionally in any aspect, the air compressor may further comprise a connecting rod, wherein the piston is configured to connect to one end of the connecting rod.

Optionally in any aspect, the shaft has a first end portion and a second end portion, said first end portion is journaled in said bearing for rotation about said axis, wherein the second end portion is received within a bore in said flywheel.

In still further another aspect, one embodiment discloses an air compressor. The air compressor comprises at least two separate cylinder housings, a pair of pistons, a distribution valve unit. Each cylinder housing may define a cylinder with an axis. The axes are parallel and spaced apart. Each piston is reciprocable in a corresponding one of the cylinders so as to reciprocate along the axis of the corresponding cylinder to vary a working volume of the cylinder. The motor has an output shaft. The pulley is on the output shaft of the motor. The drive belt connects the pulley and flywheel. The drive belt transmits torque from said output shaft to said flywheel so as to rotate said flywheel about said axis upon rotation of said output shaft. The crank shaft interconnects said flywheel with said piston so as to reciprocate said piston in said cylinder upon rotation of said flywheel.

BRIEF DESCRIPTION OF THE DRAWINGS

In order to illustrate the technical solutions more clearly in the embodiments of the present disclosure or the exemplary techniques, the drawings to be used in the embodiments or the description of the exemplary embodiments will be briefly described below. Obviously, the drawings in the following description are only certain embodiments of the present disclosure, and other drawings may be obtained according to the structures shown in the drawings without any creative work for those skilled in the art.

DETAILED EMBODIMENTS

Figure 1:
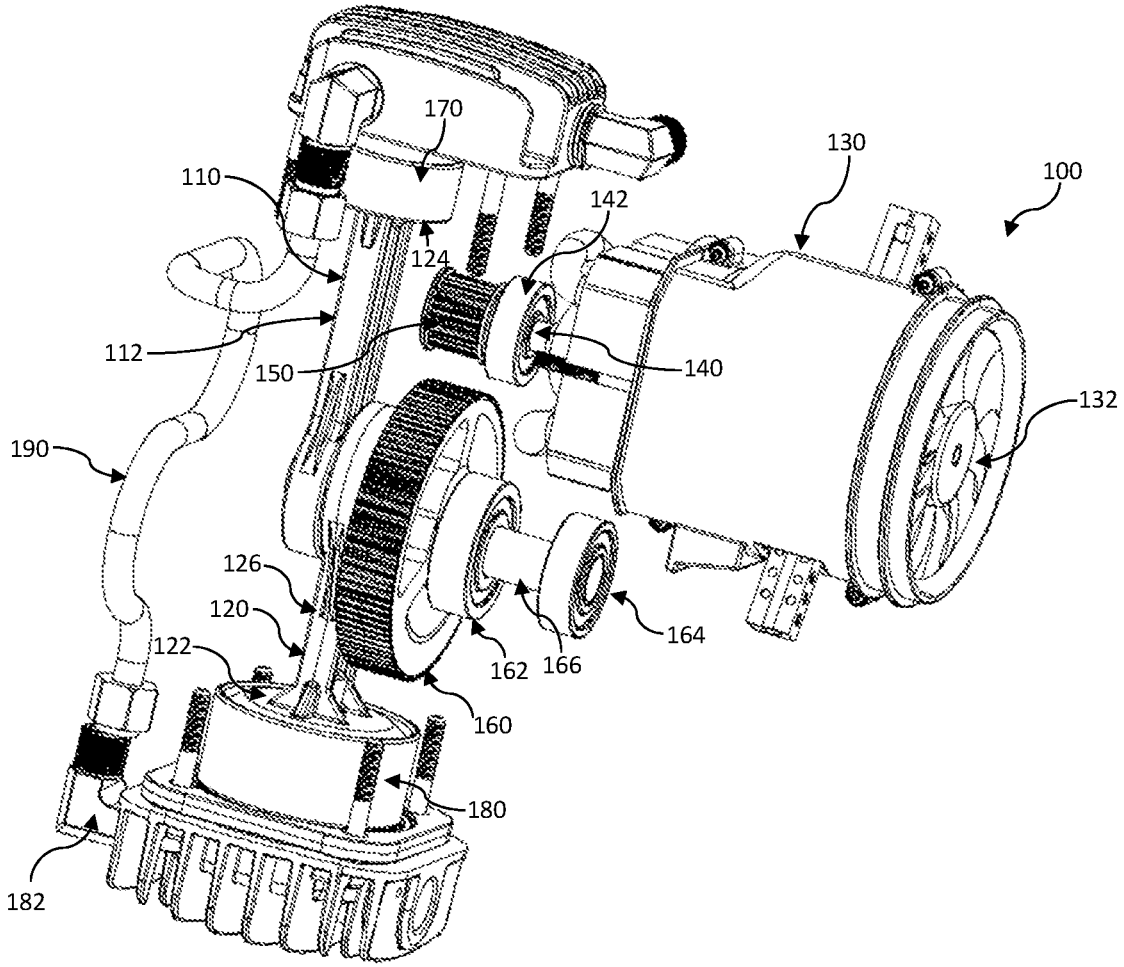
FIG. 1 is a perspective view of an air compressor by removing covering to show a pulley and a flywheel according to one exemplary embodiment.

The invention is not limited to the particular methodology, protocols, and reagents described herein because they may vary. Further, the terminology used herein is for the purpose of describing particular embodiments only and is not intended to limit the scope of the present invention. As used herein and in the appended claims, the singular forms "a," "an," and "the" include plural reference unless the context clearly dictates otherwise.

Unless otherwise indicated, all numbers expressing quantities or qualities, properties used in the specification and claims are to be understood as being modified in all instances by the term "about." Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of reported significant digits and by applying ordinary rounding techniques.

Notwithstanding that the numerical ranges and parameters set forth the broad scope of the invention are approximations, the numerical values set forth in specific examples are reported as precisely as possible. Any numerical value, however, inherently contain certain errors necessarily resulting from the standard deviation found in their respective testing measures.

As used herein, the term "about" means plus or minus 10% of the numerical value of the number with which it is being used. Therefore, about 50 means in the range of 45-55.

Unless defined otherwise, all technical and scientific terms and any acronyms used herein have the same meanings as commonly understood by one of ordinary skill in the art in the field of the invention. Although any methods and materials similar or equivalent to those described herein can be used in the practice of the present invention, the preferred methods, devices, and materials are described herein. The technical means, creative features, objectives, and effects of the patent application may be easy to understand, the following embodiments will further illustrate the patent application. However, the following embodiments are only the preferred embodiments of the utility patent application, not all of them. Based on the examples in the implementation manners, other examples obtained by those skilled in the art without creative work shall fall within the protection scope of the present invention. The experimental methods in the following examples are conventional methods unless otherwise specified. The materials used in the following examples can be obtained from commercial sources unless otherwise specified.

Embodiments of the present invention are directed to an air compressor for a source of compressed air on motor vehicles, and method for designing a more efficient reciprocating piston compressor.

The present disclosure relates to a two-cylinder piston compressor for generating compressed air. The piston compressor has a crankcase for rotatably mounting a crankshaft on which a number of connecting rods are rotatably mounted so as to run counter to one another. The number of connecting rods corresponds to the number of pistons with associated cylinders.

On account of the associated very high compressed air demand, two-stage piston compressors are usually used here, which are correspondingly of two-cylinder design. With two-cylinder piston compressors of the above type, the required compressed air demand can be generated within short periods of time.

The present disclosure relates to a two-cylinder piston compressor for generating compressed air. The piston compressor includes a crankcase having an interior, and a crankshaft rotatably mounted in the crankcase. Also included are two connecting rods mounted in the crankshaft and configured to run counter to one another. Further included are two cylinders mounted in the crankcase and a piston arranged at an end of each of the connecting rods and configured to run in a respective one of the two cylinders.

The present disclosure encompasses the technical teaching that, in order to assist the pumping effect, each piston operates in a separate cylinder. The separate cylinders are generated by separating means which are arranged in the crankcase and which surround the crankshaft, so that different pressure conditions are generated in the chambers. The air compressor is constructed in accordance with the invention, and operates to supply a storage chamber with compressed air. An outlet hose (not shown) may extend from the air compressor to a pneumatically powered tool (not shown) such a hand-held nail gun, impact wrench, or the like.

As shown in FIGS. 1-4, the air compressor 100 comprises a motor 130, a pair of pistons 122 and 124, a flywheel 160, a pulley 150, a crankshaft 350. Each piston 122 or 124 is reciprocable in a corresponding one of the cylinders 180, and 170 so as to reciprocate along the axis C-C' and B-B' (shown in FIG. 3) of the corresponding cylinder 180 and 170 respectively, to vary a working volume of the cylinder 180 and 170.

The motor 130 comprises an output shaft 140. Attached onto the output shaft 140 is a bearing 142 to support the pulley 150. The pulley 150 may transmit torque from said output shaft 140 to said flywheel 160 so as to rotate said flywheel 160 about said axis D-D' (shown in FIG. 3) upon rotation of said output shaft 140. The crankshaft 350 interconnects said flywheel 160 with said piston 122 or 124 so as to reciprocate said piston 122 or 124 in said cylinder 180 or 170 upon rotation of said flywheel 160. The diameter of the pulley 150 is smaller than that of said flywheel 160.

In one embodiment, the ratio between the diameter of the pulley 150 and that of flywheel 160 may be about 27:104. The gear ratio between the pulley 150 and the flywheel 160 may be about 27:104. In one embodiment, the drive belt 210 may be used to transmit torque from the output shaft 140 to the flywheel 160.

Figure 3:
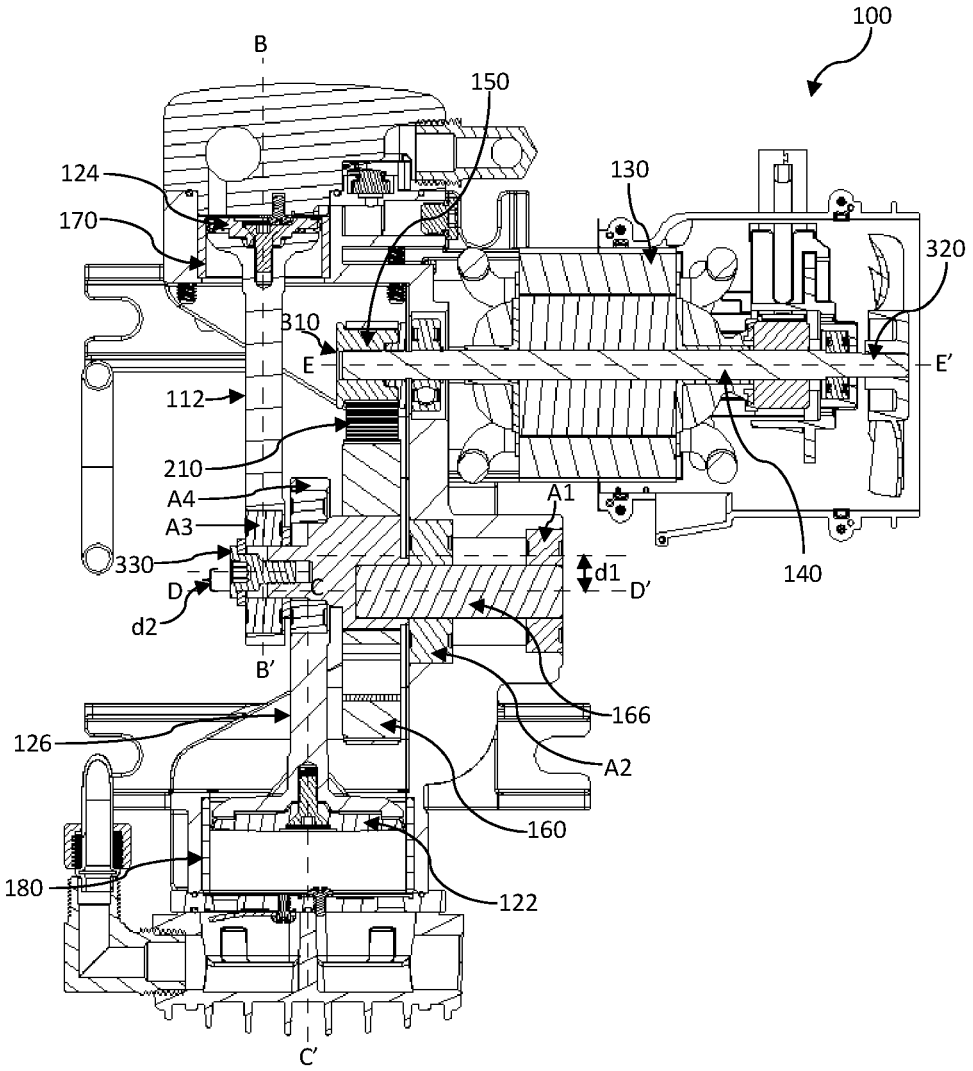
FIG. 3 illustrates a cross-sectional view of the air compressor.

The motor 130 has an output shaft 140 with a longitudinal central axis E-E' (shown in FIG. 3). A first end portion 310 of the output shaft 140 projects a distance from the motor 130 at one side of the air compressor 100. A second end portion 320 of the output shaft 140 projects oppositely from the motor 130 and is opposite from the first end portion 310. A cooling fan 132 is mounted on the second end portion 320 of the output shaft 140. Also mounted on the second end portion 310 is a pulley 150 for a drive belt 210 that transmits torque from the output shaft 140 to the flywheel 160.

Figure 2:
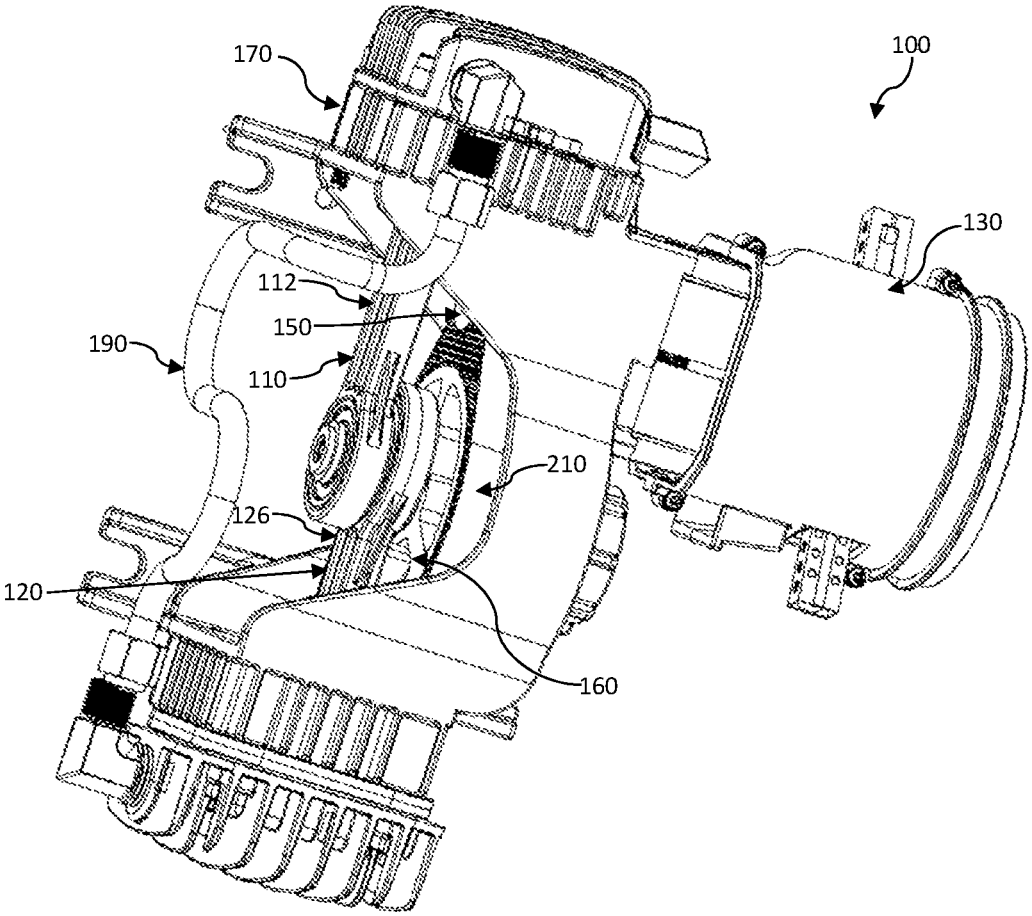
FIG. 2 is a perspective view of an air compressor by removing partial covering to show a pulley, drive belt, and a flywheel according to one exemplary embodiment.

The bearings 162 and 164 support the shaft 72 and the flywheel 160 for rotation about an axis D-D' parallel to the axis E-E' of the output shaft 140 (FIG. 2).

The piston 122 is supported for reciprocating movement along an axis C-C' perpendicular to the axes D-D' and E-E'. Similarly, the piston 124 is supported for reciprocating movement along an axis B-B' perpendicular to the axes D-D' and E-E'.

The piston 122 or 124 in one embodiment is part of a linkage member 120 or 110 that is connected to the flywheel 160. The linkage member 120 may comprise a connecting rod 126 and bearing A4 (FIG. 3) supports the linkage member 120. The linkage member 110 may comprise a connecting rod 112 and bearing A3 (FIG. 3) which supports the linkage member 110 on a support member 330 that projects from the flywheel 160. The support member 330, in one embodiment, is screw, for example. The screw may be a flat head screw.

When the flywheel 160 rotates about the axis D-D', the screw 330 moves along a circular path extending around the axis D-D'. This causes the linkage member 110 also to move around the axis D-D', and simultaneously to move back and forth along the axis B-B'. The piston 124 then reciprocates along the axis B-B', and thus pumps compressed air to an outlet port, upon rotation of the flywheel 160 under the influence of the output shaft 140 at the motor 130.

Similarly, the flywheel 160's rotation about the axis D-D' also causes the linkage member 120 to move around the axis D-D', and simultaneously to move back and forth along the axis C-C'. The piston 122 then reciprocates along the axis C-C', and thus pumps compressed air to the outlet port 182, upon rotation of the flywheel 160 under the influence of the output shaft 140 at the motor 130. In one embodiment, cylinder 180 may be a low pressure cylinder. Cylinder 170 may be a high pressure cylinder.

Furthermore, the compressed air is released from the outlet port 182 of the cylinder 180 to the cylinder 170 via a conduit 190, wherein the conduit 190 forms a plurality of bends. As shown in FIG. 2, the conduit 190 may be used to connect the low pressure cylinder 180 and the high pressure cylinder 170. The conduit 190 may comprise a one way valve (not shown), which help air to move from the low pressure to high pressure. The conduit 190 is designed as a plurality of continuously bent pipes, which can extend the flow path of the compressed air, thereby achieving the effect of heat dissipation. Preferably, the conduit 190 is a copper pipe, for example.

In the embodiment of the present invention, the cylinder 170 is connected to an air storage tank (not marked in the figure) via an air outlet. The air storage tank is used to store compressed air. Generally, an aluminum tank or other metal tanks that can bear a certain pressure are selected, and a one-way guide valve is provided between the cylinder 170 and the air storage tanks.

Figure 4:
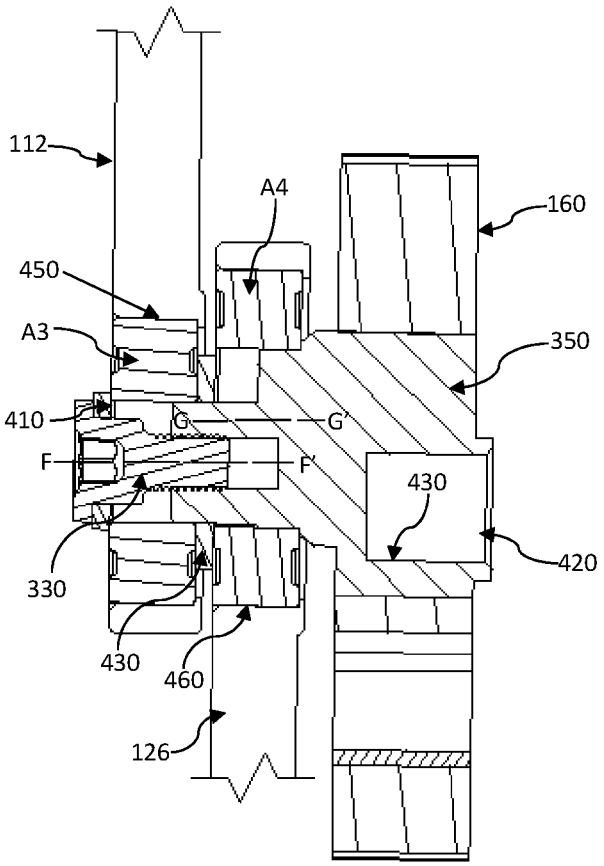
FIG. 4 illustrates an enlarged view of the crankshaft, flywheel as shown in FIG. 3. The implementation, functional features and advantages of the present disclosure will be further described with reference to the accompanying drawings.

More specific features of the air compressor 100 are shown in FIGS. 3-4. For example, as shown in FIG. 3, the air compressor 100 further comprise bearings 162 and 164 supporting the flywheel 160 for rotation about an axis D-D'. The air compressor 100 may further comprise a shaft extending along said axis D-D' between said flywheel 160 and said bearing 164. The shaft has a first end portion and a second end portion. The first end portion may be journaled in the bearing 164 for rotation about the axis D-D'.

The flywheel 160 has an inner surface 430 defining a bore 420 in which the second portion of the shaft 166 is received. In one embodiment, the inner surface 100 may be parallel to the axis D-D', for example. In another embodiment, the inner surface 430 may be frustoconical shape and is tapered uniformly along its length such that an inner end of the bore 420 may have a diameter that is slightly less than the diameter at an outer end. The shaft 166 may be equally tapered at its outer surface, and is received within the bore 420 in an interference fit with the flywheel 160.

The outer surface of the shaft 166 is engaged in an interference fit with the first bearing 162 in the same manner. The shaft 166 has a cylindrical outer surface which is likewise engaged in an interference fit with the second bearing 164.

The shaft 166 is machined such that the outer surface complies with close dimensional tolerances. However, the inner surface 430 of the flywheel 160 may not machined to close dimensional tolerances, but instead has the original configuration attained upon formation of the flywheel 160 as a cast metal part. The tapered or non-tapered of the adjoining surfaces 430 and cylindrical outer surface of the shaft 166 enables the interference fit to be established without the need for precision machining at the inner surface 430. The manufacturing process is simplified, and a corresponding cost savings are achieved, by forming the torque-transmitting connection between the flywheel 160 and the shaft 166 in this manner.

The linkage member 120 is an elongated part with a longitudinal central axis C-C' (FIG. 3). A first end portion of the linkage member 120 is configured as a circular disk with a diameter generally perpendicular to the axis D-D'. The second end portion of the linkage member 120 defines the piston 122 (FIG. 1), as noted above.

Similarly, the linkage member 110 is an elongated part with a longitudinal central axis B-B' (FIG. 3). A first end portion of the linkage member 110 is configured as a circular disk with a diameter generally perpendicular to the axis D-D'. The second end portion of the linkage member 110 defines the piston 170 (FIG. 1), as noted above.

The bearing A3 at the other end of the linkage member 110 is mounted on the linkage member 110 in an interference fit. Specifically, the elongated body of the linkage member 110 has an opening, which comprises a pocket for the bearing A3, and is defined by an inner edge surface 450.

The two bearings A3 and A4 are kept on a crankshaft 350, and the driving shaft 140 of the motor 130 is connected with the crankshaft 350 through a driving belt 210. The output torque of the crankshaft part portion is greater than the input torque of the driving shaft 140. The motor 130 may be a brush inner rotor type motor, for example, fixed on one side of the crankshaft 350. In this case, the driving shaft 140 of the motor 130 is connected with the crankshaft 350 through a transmission component, such as the driving belt 210 and the torque output by the eccentric shaft portion is greater than the torque input by the driving shaft 140, so that the low-torque motor can work in a high-load working condition by changing the torque of the driving shaft 140 and the crankshaft within an adjustable range without increasing the cost of the motor.

Furthermore, the output end of the driving shaft 140 is provided with the pulley 150; the flywheel 160 may be arranged on the side far away from the pulley 150, and one end of the crankshaft 160 is constructed in the flywheel 160. The transmission component may comprise the driving belt 210, and the pulley 150 and the flywheel 160 which is transmitted by the driving belt 210.

Further, the gear ratio between the pulley 150 and the flywheel 160 may be 27:104. This makes it possible to reduce the rotational speed of the flywheel 160 by a predetermined gear ratio to achieve the effect of reducing the rotational speed to increase the torque.

In the embodiment of the present invention, the rotation axis of the bearings A3 and A4 held on the crankshaft 160 and the axis D-D' of the flywheel 160 have different eccentricities d2 and d1. As shown in FIG. 3, the eccentric distance between the bearing A3 and the axis D-D' of the flywheel 160 is d2, and the eccentric distance between the bearing A4 and the transmission axis of the flywheel 160 is d1, so that the connecting rod 112 matched with the bearing A3. the connecting rod 126 matched with the bearing A4 have different compression strokes. The compression stroke of the pistons 124 and 122 can be more conveniently and flexibly adjusted.

The inner edge surface 450 extends continuously in a closed loop around an axis F-F' which intersects the axis B-B' orthogonally. A major section of the inner edge surface 450 has an annular contour centered on the axis F-F', and thus defines a circular portion of the opening.

The bearing A4 at the other end of the linkage member 120 is mounted on the linkage member 120 in an interference fit. Specifically, the elongated body of the linkage member 120 has an opening, which comprises a pocket for the bearing A4, and is defined by an inner edge surface 460. The inner edge surface 460 extends continuously in a closed loop around an axis G-G' which intersects the axis B-B' orthogonally. A section of the inner edge surface 460 has an annular contour centered on the axis F-F', and thus defines a circular portion of the opening.

In accordance with a particular feature of the invention, the linkage member 110 or 120 may be a cast metal part. A washer 410 may be used for tightly sealing the screw 330 to the bearing A3. Similarly, a washer 430 may be used for tightly sealing the bearing A3 and the bearing A4.

In the embodiment of the present invention, according to FIGS. 1-4, the bearings A3 and A4 are locked to the axial direction of the crankshaft 160 through the screw 330. And a threaded hole (not marked in the figure) capable of being screwed by the screw 330 is formed on the crankshaft 350, so that the screw 330 can be locked into the bolt hole. And the washer 410 is arranged between the bolt head and the bearing A3. And another washer 430 is arranged between the bearings A3 and A4, particularly at the position shown in FIG. 4, so that the bearings A3 and A4 can respectively keep a predetermined distance to work in the working process without causing mutual interference, and one end of the shaft 166 is kept in the crankshaft 350.

One end of the shaft 166 can be held in the bore 420 of the crankshaft 350 by means of an interference fit, and the other end is held on the crankshaft 350 by means of two bearings A1, A2. In the embodiment of the present invention, the crankshaft 350 and the flywheel 160 may be preferably integrally formed to maintain a certain structural strength. It is also possible to manufacture the crankshaft 350 and the flywheel 160 separately and then assemble them if the manufacturing process does not permit or the cost is considered.

It will be appreciated by persons skilled in the art that numerous variations and/or modifications may be made to the invention as shown in the specific embodiments without departing from the scope of the invention as broadly described. The present embodiments are, therefore, to be considered in all respects as illustrative and not restrictive.

The above shows and describes the basic principles, main features and advantages of the patent application. Those skilled in the industry should understand that the present patent application is not limited by the above-mentioned embodiments. The above-mentioned embodiments and the description are only preferred examples of the present patent application and are not intended to limit the present patent application, without departing from the present utility patent application. Under the premise of spirit and scope, the present utility patent application will have various changes and improvements, and these changes and improvements fall within the scope of the claimed utility patent application.

The scope of protection claimed by the utility patent application is defined by the appended claims and their equivalents.

We claim:

1. An air compressor comprising:

a pair of pistons, each piston being reciprocable in a corresponding one of two cylinders so as to reciprocate along a first axis of the corresponding cylinder to vary a working volume of the corresponding cylinder;

a motor having an output shaft;

a flywheel;

a pulley which transmits torque from said output shaft to said flywheel so as to rotate said flywheel about a second axis upon rotation of said output shaft;

a bearing supporting said flywheel for rotation about the second axis;

a shaft extending along the second axis between said flywheel and said bearing, wherein said shaft has a first end portion and a second end portion; and a crankshaft interconnecting said flywheel with said piston so as to reciprocate said piston in said cylinder upon rotation of said flywheel;

wherein diameter of the pulley is smaller than that of said flywheel.

2. The air compressor of claim 1, wherein the ratio between the diameter of the pulley and that of flywheel is about 27:104.

3. The air compressor of claim 1 further comprising a drive belt transmitting torque from said output shaft to said flywheel.

4. The air compressor of claim 1, wherein said first end portion is journaled in said bearing for rotation about said second axis.

5. The air compressor of claim 1, wherein the second end portion is received within a bore in said flywheel.

6. The air compressor of claim 1 further comprising a connecting rod, wherein each piston is configured to connect to one end of the connecting rod.

7. The air compressor of claim 1, wherein the cylinders have at least one low pressure cylinder and a high pressure cylinder.

8. The air compressor of claim 7 further comprises a conduit connecting the low pressure cylinder and the high pressure cylinder.

9. An air compressor, comprising:

a motor having an output shaft;

a flywheel;

a pulley on the output shaft of the motor, a bearing supporting said flywheel for rotation about an axis;

a shaft extending along the second axis between said flywheel and said bearing; and a drive belt connecting the pulley and flywheel, wherein the drive belt transmits torque from said output shaft to said flywheel so as to rotate said flywheel about said axis upon rotation of said output shaft, wherein diameter of the pulley is smaller than that of said flywheel; and a crank shaft interconnecting said flywheel with a piston so as to reciprocate said piston in a cylinder upon rotation of said flywheel.

10. An air compressor, comprising:

a pair of pistons, each piston being reciprocable in a corresponding one of two cylinders so as to reciprocate along a first axis of the corresponding cylinder to vary a working volume of the cylinder;

a motor having an output shaft;

a flywheel;

a pulley on the output shaft of the motor;

a drive belt connecting the pulley and flywheel, wherein the drive belt transmits torque from said output shaft to said flywheel so as to rotate said flywheel about a second axis upon rotation of said output shaft;

a bearing supporting said flywheel for rotation about the second axis;

a shaft extending along the second axis between said flywheel and said bearing; and a crank shaft interconnecting said flywheel with said piston so as to reciprocate said piston in said cylinder upon rotation of said flywheel.

11. The air compressor of claim 10, wherein the diameter of the pulley is smaller than that of said flywheel.

12. The air compressor of claim 11, wherein the ratio between the diameter of the pulley and that of flywheel is about 27:104.

* * * * *